US010542864B2

(12) United States Patent
Digman

(10) Patent No.: US 10,542,864 B2
(45) Date of Patent: Jan. 28, 2020

(54) DISHWASHER RACK ACCESSORY FOR SECURING ARTICLES

(71) Applicant: Midea Group Co., Ltd., Beijiao, Shunde, Foshan (CN)

(72) Inventor: Robert Digman, Goshen, KY (US)

(73) Assignee: MIDEA GROUP CO., LTD., Beijiao, Shunde, Foshan, Guangdong (CN)

( * ) Notice: Subject to any disclaimer, the term of this patent is extended or adjusted under 35 U.S.C. 154(b) by 63 days.

(21) Appl. No.: 15/939,545

(22) Filed: Mar. 29, 2018

(65) Prior Publication Data

US 2019/0298147 A1 Oct. 3, 2019

(51) Int. Cl.
*A47L 15/50* (2006.01)

(52) U.S. Cl.
CPC ..... *A47L 15/505* (2013.01)

(58) Field of Classification Search
None
See application file for complete search history.

(56) References Cited

U.S. PATENT DOCUMENTS

| | | | |
|---|---|---|---|
| 4,757,578 | A | 7/1988 | Lamb |
| 4,832,206 | A | 5/1989 | Cunningham |
| 4,869,375 | A | 9/1989 | Lamb |
| 4,974,806 | A | 12/1990 | Matern |
| 5,102,225 | A | 4/1992 | Hollinger et al. |
| 5,114,019 | A | 5/1992 | Sandbank |
| 5,121,843 | A | 6/1992 | Elder |
| 5,201,826 | A | 4/1993 | Zimmermann |
| 5,294,008 | A | 3/1994 | Dunaway |
| 5,497,890 | A | 3/1996 | Clark |
| 5,518,126 | A | 5/1996 | Davis |
| 5,988,406 | A | 11/1999 | Leipziger |
| 6,364,131 | B1 | 4/2002 | Moylan |
| 6,371,642 | B1 | 4/2002 | Nelson et al. |
| 6,394,285 | B1 | 5/2002 | Arthurs et al. |
| 6,675,977 | B2 | 1/2004 | Parks |
| 7,458,471 | B2 | 12/2008 | Crudgington, Jr. |
| 7,988,107 | B2 | 8/2011 | Miller et al. |
| 8,152,001 | B1 | 4/2012 | Vinklarek et al. |

FOREIGN PATENT DOCUMENTS

| | | |
|---|---|---|
| CN | 101785653 A | 7/2010 |
| EP | 2554098 B1 | 4/2015 |

OTHER PUBLICATIONS

ThriftyFun "Washing Small Items in the Dishwasher" www.thriftyfun.com. Retrieved on Apr. 6, 2017, 6 pages.
Parents' Favorite "Boon Span Dishwasher Net 1Pk" www.parentsfavorite.com. Retrieved on Apr. 6, 2017, 3 pages.
Amazon "Band It Dishwasher Loop" www.amazon.com, Retrieved on Apr. 6, 2017, 6 pages.
Starbrite "Sail Lash With Ball Ends" www.starbrite.com. Retrieved on Mar. 9, 2018, 1 page.
International Search Report and Written Opinion issued in Application No. PCT/CN2019/078800 dated Jun. 26, 2019.

*Primary Examiner* — Eric W Golightly
(74) *Attorney, Agent, or Firm* — Middleton Reutlinger

(57) ABSTRACT

An apparatus and method of using a strap assembly for retaining at least one article to a dishwasher rack. The strap assembly may include a spherical member on each of the opposing ends of a resilient member. One or more of the strap assemblies may be positioned in a variety of orientations with the dishwasher rack to contact one or more articles.

12 Claims, 5 Drawing Sheets

DISHWASHER RACK ACCESSORY FOR SECURING ARTICLES

BACKGROUND

The present embodiments relate to an appliance rack, drawer, or shelf, with particular embodiments shown for a dishwasher rack for a dishwasher appliance.

Typical dishwasher racks may include a fixed retention device to secure articles within the dishwasher rack. However, this structure is often rigid, fixed in locations, or difficult to rearrange for adjustability to secure a variety of articles of different shapes, sizes, etc. Thus, there is a need for one or more retention devices capable of securing one or more articles while maintaining the ability to rearrange easily into or out of one or more engagement positions with the articles.

SUMMARY

In some embodiments of the invention, for example, a strap assembly for retaining at least one article with a dishwasher rack may comprise at least one resilient member having a first end and an opposing second end. In various embodiments, the strap assembly may include a first spherical member attached to the first end of at least one resilient member. In addition, in some embodiments, the strap assembly may include a second spherical member attached to the second end of at least one resilient member. In various embodiments, at least one resilient member may include one or more through openings positioned between the first spherical member and the second spherical member.

In some embodiments, a portion of each one of at least one resilient member, the first spherical member, and the second spherical member may include an outermost extent made of a first material. In various embodiments, the first material may be at least one of silicone and a thermoplastic elastomer. Moreover, in some embodiments, at least one resilient member may be made entirely of the first material. In some embodiments, the first spherical member and the second spherical member may be made entirely of the first material. In various embodiments, at least one of the first spherical member and the second spherical member may include a second material, wherein said second material may be covered by the first material. In addition, in some embodiments, the second material may be denser than the first material. In some embodiments, the at least one resilient member may include a plurality of resilient members. In various embodiments, at least one resilient member may be adjustable in length.

In some embodiments, a strap assembly for retaining at least one article with a dishwasher rack may comprise at least one resilient member having a first end and an opposing second end. In various embodiments, the strap assembly may include a first spherical member attached to the first end of at least one resilient member. In some embodiments, the strap assembly may include a second spherical member attached to the second end of at least one resilient member. In addition, in some embodiments, each one of at least one resilient member, the first spherical member, and the second spherical member may include an outermost extent made of a first material, wherein the first material may be at least one of silicone and a thermoplastic elastomer.

In addition, in some embodiments, the first spherical member and the second spherical member may be co-molded with the at least one resilient member. In various embodiments, the first spherical member and the second spherical member may be integrally molded with the at least one resilient member. Moreover, in some embodiments, the at least one resilient member may include a plurality of resilient members. In various embodiments, the first spherical member may include a second material over molded by the first material. In some embodiments, at least one resilient member may include one or more through openings positioned between the first spherical member and the second spherical member.

In various embodiments, a method of retaining articles in a dishwasher rack may comprise the step of providing one or more strap assemblies having at least one resilient member, a first spherical member, and a second spherical member. In some embodiments, the at least one resilient member may include an opposing first end and a second end, the first spherical member attached to the first end of at least one resilient member and the second spherical member attached to the second end of at least one resilient member. In some embodiments, the method may include positioning one or more articles within the dishwasher rack. In various embodiments, the method may include securing the first end of at least one of the one or more strap assemblies to the dishwasher rack with the first spherical member. In some embodiments, the method may include securing the second end of at least one of the one or more strap assemblies to the dishwasher rack with the second spherical member. In addition, in some embodiments, the method may include maintaining the position of the one or more articles within the dishwasher rack with at least one resilient member of the one or more strap assemblies contacting the one or more articles.

In addition, in some embodiments, the method may include stretching at least one of one or more strap assemblies between the first end and the second end secured to the dishwasher rack. In some embodiments, the one or more strap assemblies may be stretched across at least one of one or more rows and one or more columns of the dishwasher rack. In various embodiments, securing the first end of at least one of the one or more strap assemblies to the dishwasher rack with the first spherical member may include the step of securing the first spherical member with a portion of the at least one resilient member. In addition, in some embodiments, the one or more strap assemblies subdivide at least one of one or more rows and one or more columns of the dishwasher rack.

These and other advantages and features, which characterize several embodiments, are set forth in the claims annexed hereto and form a further part hereof. However, for a better understanding of the embodiments, and of their advantages and objectives, reference should be made to the drawings and to the accompanying description, in which there are described example embodiments. This summary is merely provided to introduce a selection of concepts that are further described below in the detailed description, and is not intended to identify key or essential features of the claimed subject matter, nor is it intended to be used to limit the scope of the claimed subject matter, nor to define the field of endeavor.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described techniques within a front-load residential dish washing machine such as dish washing appliance 10, such as the type that may be used in single-family or multi-family dwellings, or in other similar applications. However, it will be appreciated that the herein-described apparatus and techniques may also be used in connection with other types of dish washing machines in some embodiments. For example, the herein-described apparatus and techniques may be used in commercial applications in some embodiments. Moreover, the herein-described apparatus and techniques may be used in connection with other dish washing machine configurations, and even other appliances, such as, for example, freezers, refrigerators, and the like.

Figure 1:
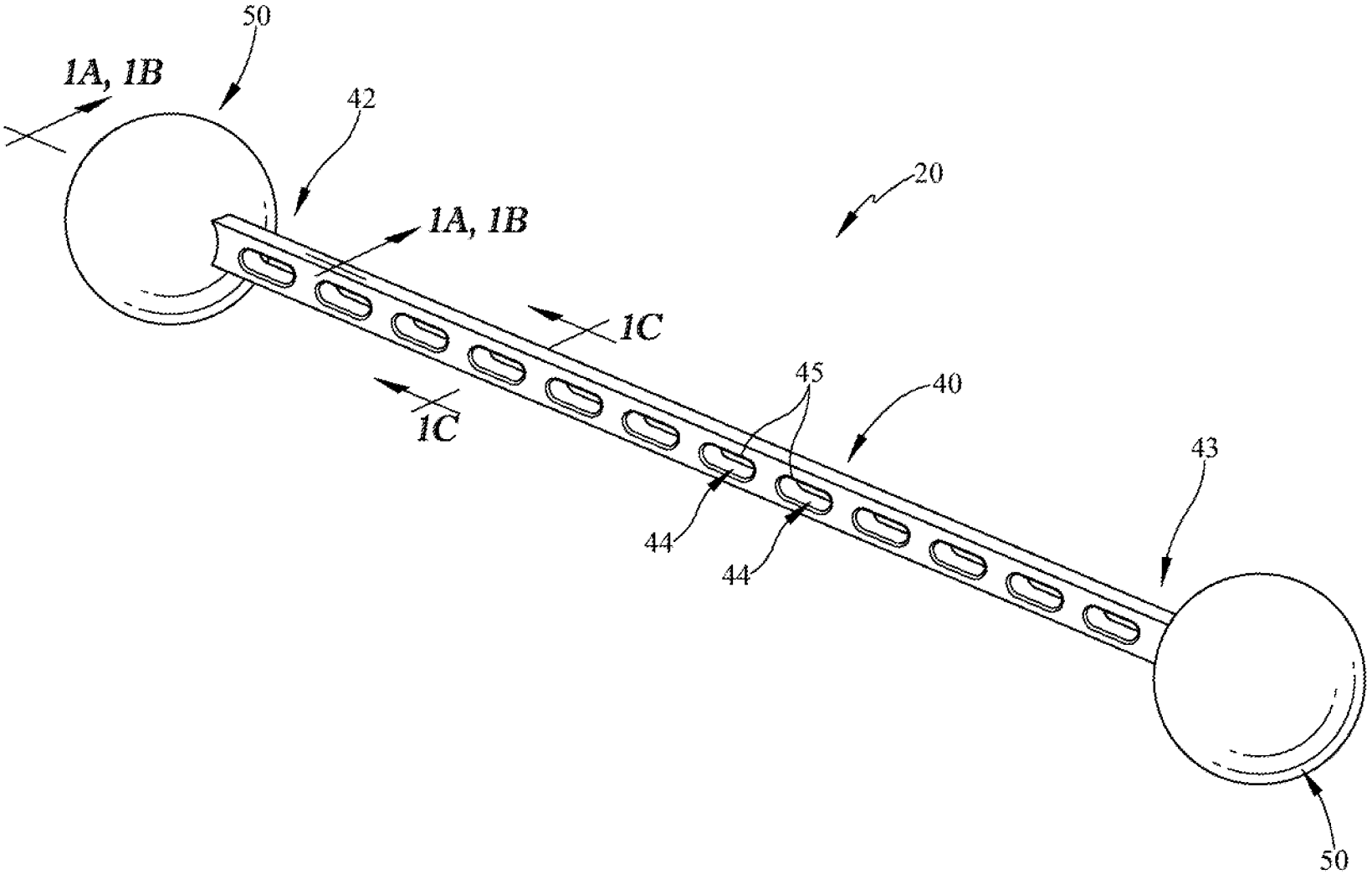
FIG. 1 is a perspective view of one embodiment of a strap assembly.

One or more strap assemblies 20 may be used to retain the positon or protect the one or more articles within a dishwasher rack 30. In the one embodiment shown in FIG. 1, the strap assembly 20 may have at least one elongated resilient member 40 having opposing ends 42 and 43. One or more ends 42 and 43 of the resilient member 40 may include a retention or spherical member 50. The spherical member 50 at one or more ends 42, 43 of the resilient member 40 may include one or more surfaces being substantially spherical in shape. One embodiment of the spherical member 50 is shown in the Figures. The spherical member 50 may be adjacent the resilient member end 42, 43 and be substantially spherical about at least a portion of its outer periphery. Although the resilient member is shown as having a spherical member 50 at each end, it should be understood that a single end 42, 43 may include the spherical member. Moreover, the spherical members may be different at each end of the resilient member, not the same as shown in the figures. In addition, in some embodiments, one or more retention or spherical members may be positioned at locations along the resilient member 40. It should also be understood that the spherical member 50 may not be substantial spherical about its entire outer periphery as shown. In some embodiments, the spherical member 50 may have one or more portions that may be spherical, convex, or arcuate and still be within the scope of the invention. For example, the outer periphery, or portions thereof, of the spherical member may be arcuate in shape while one or more remaining portions may be recessed, planar, and/or concave surfaces. Moreover for example, in some embodiments, a planar surface of the spherical member 50 may be adjacent the resilient member 40 and the opposing surface or hemisphere shape of the retention member may be spherical in shape. The spherical member 50 may be a variety of shapes, sizes, quantities, and constructions and still be within the scope of the invention. Moreover, in some embodiments, the retention member may a variety of shapes other than spherical. For example, the retention member may be arrow like in shape, with the point extending away from the one or more resilient members. Moreover, for example, the retention member may be a bar or tubular member arranged perpendicular to the end of the one or more resilient members.

Figure 4:
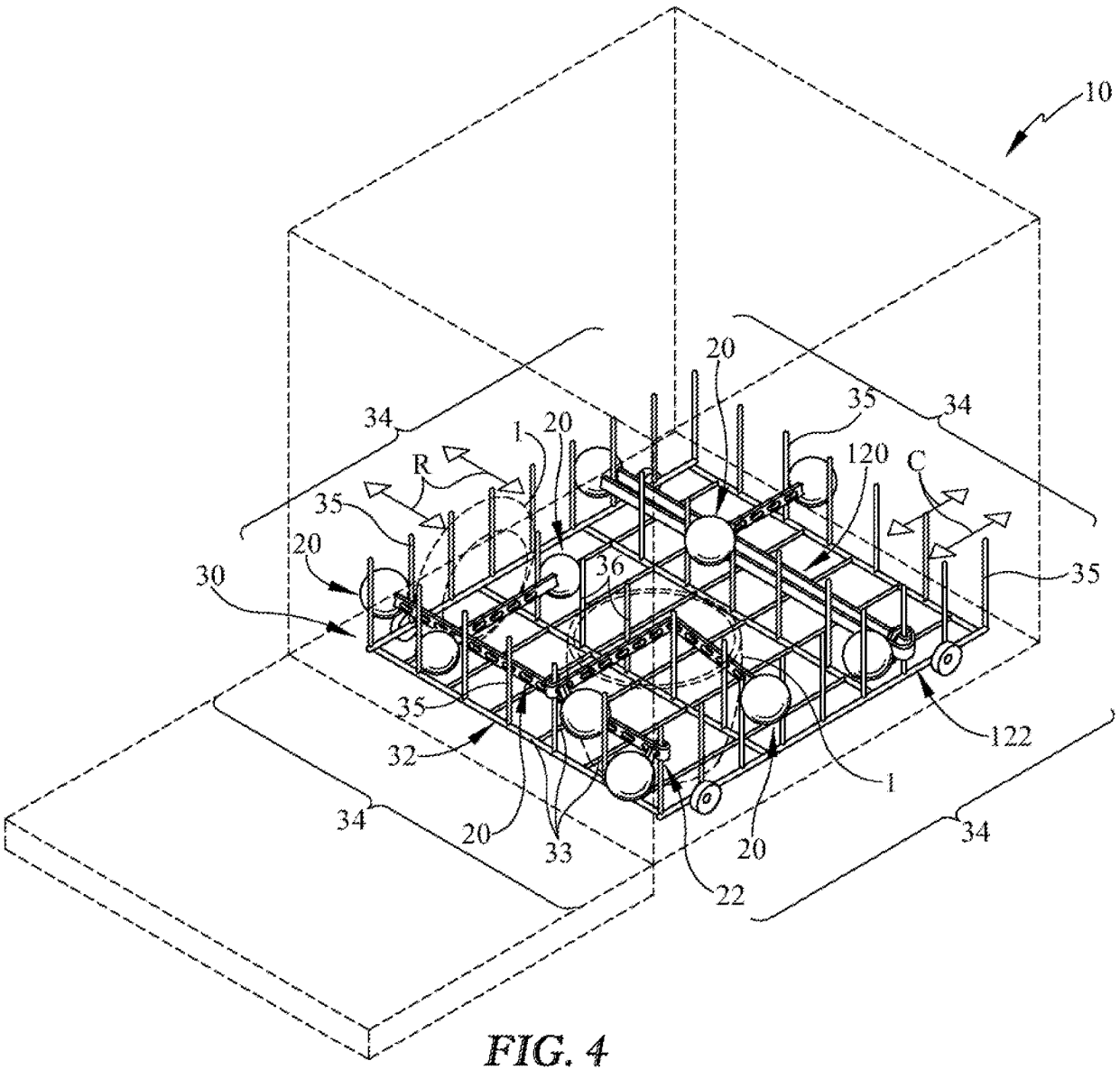
FIG. 4 is a perspective view of the strap assemblies of FIGS. 1 and 2 securing one or more articles within one embodiment of a dishwasher rack of a dish washing appliance.

One or more strap assemblies 20 may also include a dishwasher rack 30 or storage apparatus in some embodiments. As shown in FIG. 4, one embodiment of dishwasher rack 30 (e.g. upper rack or lower rack) of the type used in residential and/or commercial dishwashers 10 may be in the form of a substantially rectangular open frame or basket having a bottom 32 and four sides 34 with parallel spaced plastic covered wire support members 33 that extend across the bottom 32 between sides 34 in a crisscross pattern to form the bottom support members of the rack and may be turned upwardly on the ends to form the vertical sides support members, or uprights 35 may surround the outer periphery of the rack bottom support members 33. A plurality of uprights or prongs 36 may extend upwardly from the bottom support members 33 that are typically used to hold the one or more articles in a one or more rows R and/or columns C of the rack 30. Moreover, the herein-described apparatus and techniques may be used in connection with other rack or storage configurations, such as, for example, drawers, shelves, and the like, and even other appliances. It should be understood that the dishwasher rack 30 may be a variety of shapes, sizes, constructions, and quantities and still be within the scope of the invention.

As shown in the figures, or more clearly in FIG. 4, one or more strap assemblies 20 may be used with the dishwasher rack 30 to secure one or more articles 1. The one or more strap assemblies 20 may be quickly engaged/disengaged to one or more portions/retention areas of the dishwasher rack 30, to one or more portions of the strap 20 itself, and/or portions of another strap assembly in a variety of orientations within the dishwasher rack. The strap assembly 20, or portions thereof, may be secured to a variety of structures of the dishwasher rack 30, for example, one or more of the bottom support members 33, vertical side support members 35, uprights/prongs 36, baskets, and/or rack structure or accessory, etc. The one or more strap assemblies 20 are positioned and/or stretched for engaging and securing an article(s) 1 within the dishwasher 10. The one or more strap assemblies may be orientated, along and/or across, one or more rows R and/or one or more columns C for a particular application. The strap assemblies may not extend from the sides 34 of the rack 30 and may extend from/between the prongs 36 in some embodiments. Moreover, for example, one or more strap assemblies 20 may extend substantially in a single row R or column C. Another example, the strap assembly 20 may extend across several rows R and/or across several columns C to engage one or more articles 1 in a variety of locations about the storage area of the rack 30. The one or more strap assemblies 20 may engage the one or more articles 1 in a variety of ways, such as engaging or contacting one or more portions of the lateral sides, top/bottom sides, etc. to reduce vertical movement and overturning. Further, for example, the ends of the strap assembly 20 may pass through portions of the article (e.g. handles of articles) and/or wrap around the exterior/interior of the article to secure the item with the dishwasher rack. Moreover, in some embodiments, the strap assemblies may subdivide a drawer or shelf in one or more appliances.

Figure 1A:
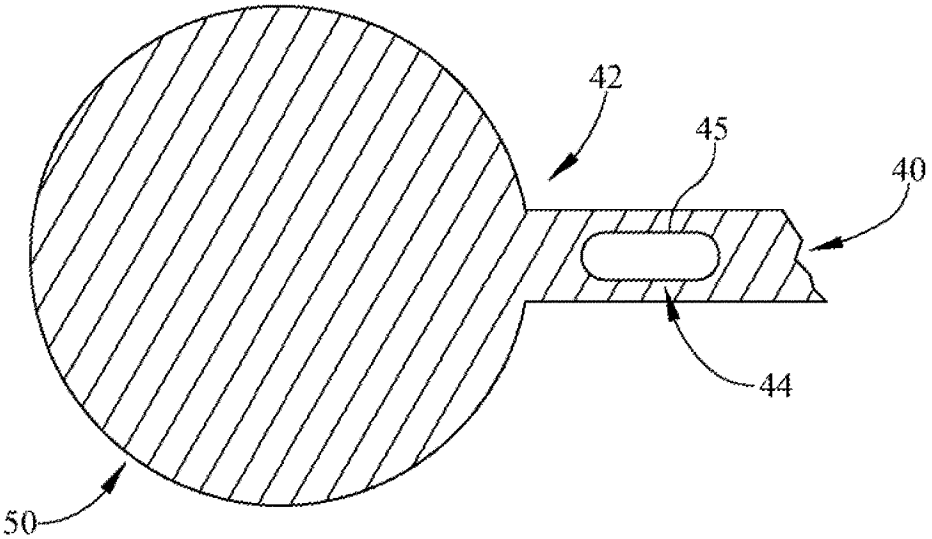
FIG. 1A is a sectional view of the strap assembly of FIG. 1 taken along line 1A-1A.
Figure 1C:
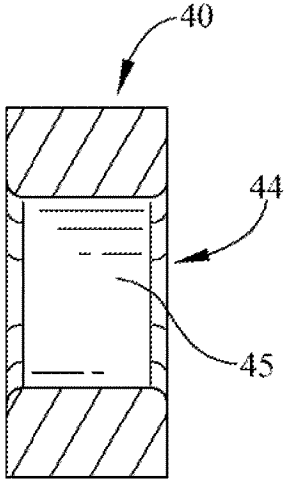
FIG. 1C is a sectional view of the strap assembly of FIG. 1 taken along line 1C-1C.

The one or more resilient members 40 may be connected to one or more of the spherical members 50 in variety of ways. For example, but not limited to, integrally formed or alternatively formed separately and securely fastened thereto by adhesive, mechanical, fasteners, etc. In the embodiment shown in FIG. 1A, at least one spherical member 50 may be integrally molded together with the resilient member 40. In the embodiment shown in FIG. 1B, the spherical member 50 may be co-molded with the resilient member (e.g. one or more materials of the spherical member over molded onto one or more materials of the resilient member). It should be understood that additional fasteners or apparatuses may be used to securely fasten the spherical member to the resilient member and still be within the scope of the invention. The resilient member 40 may be a variety of shapes, sizes, quantities, and constructions and still be within the scope of the invention. For example, as shown in the embodiment in FIG. 1C, the cross section of the resilient member 40 may be substantially rectangular in shape. However, other cross sections are contemplated such as, but not limited to, tubular, square, or triangular in shape. Moreover, the resilient member included in several strap assemblies may be a variety of lengths to allow the user to select the appropriate strap and corresponding length per a particular application for one or more articles.

In some embodiments, the one or more resilient members 40 may include one or more catches 44. If used, the one or more catches 44 may be positioned along the length of the resilient member 40 to engage one or more of the spherical members 50 of the same strap assembly and/or another strap assembly and/or in some embodiments portions of the dishwasher rack 30. In some embodiments, the one or more catches 44 may be apertures or through openings 45 longitudinally spaced along the length of the one or more resilient members 40. The catches 44 may be a variety of shapes, sizes, quantities, and constructions and still be within the scope of the invention. Moreover, if used, (e.g. FIG. 1), the resilient member 40 may include apertures 45 for catches 44. In other embodiments of the strap assembly 120 (FIG. 3), the resilient member 40 may not include apertures. The apertures 45 may expand and receive a portion of the spherical member(s) 50 of one or more strap assemblies 20 or allow the spherical member 50 to pass through. With the aperture flexing back to its original and smaller size, the spherical member or portions thereof may not readily be pulled out or removed until sufficient force by the user expands or overcomes the force applied by the aperture restricting back to its rest position to allow the spherical member to return therethrough. As a result, an end of the strap 20 may create a loop 22 to engage one or more portions of the dishwasher rack (e.g. 33, 35, 36, etc.). For example, as shown in the one embodiment of FIG. 4, the loop 22 surrounds a vertical upright 35.

Figure 3:
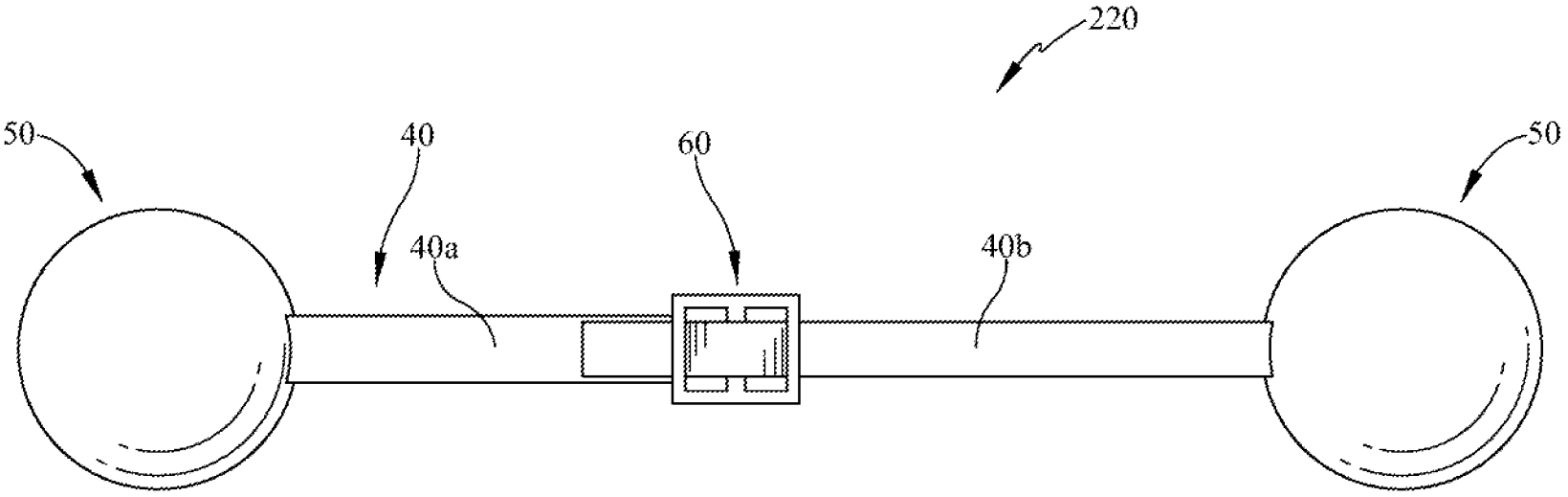
FIG. 3 a top view of another embodiment of a strap assembly illustrating the resilient member and/or strap assembly being adjustable in length.

In some implementations, one or more straps 220 may be adjustable in length. By utilizing one or more catches 44, the overall length of the strap 20 may be shortened and/or lengthen depending on the application. In the embodiment shown in FIGS. 1 and 4, the strap with or without a looped 22 end may adjust the overall length that needs to be stretched. Moreover, as shown in FIG. 3, some embodiments of the strap assembly 220 may be adjustable in length by including a buckle 60, clip, clamp, etc. to adjust the distance between the spherical members. Although the resilient member 40 may be separate smaller portions 40*a*, 40*b* as shown in FIG. 3, the buckle 60 or similar device, if used, may combine the two lengths/portions 40*a*, 40*b* or shorten a resilient member 40 to adjust the length of the resilient member between one or more spherical members 50.

Figure 2:
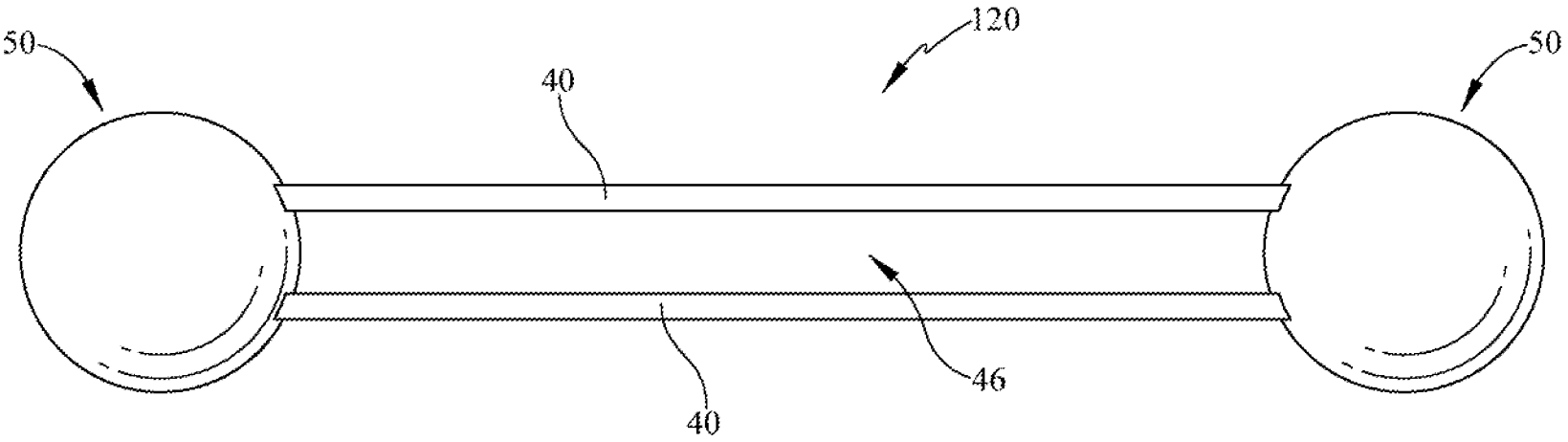
FIG. 2 a top view of another embodiment of a strap assembly.

In some embodiments, two or more resilient members 40 may extend between the retention members. As shown in the one embodiment of the strap assembly in FIGS. 2 and 4, the strap assembly may include two or more resilient members 40 connecting the spherical members 50. The resilient members and spherical members define a space or inner periphery 46 therebetween. The space 46 defined may be a variety of shapes, sizes, quantities, and constructions and still be within the scope of the invention. Catches 44, if used, may be positioned along one or more of the resilient members. As shown in FIG. 4, the opposing ends of the strap 120 may engage the dishwasher rack or retention area of the rack in a variety of ways. When stretched, the uprights 35 and/or prongs 36 may project between the two resilient members 40 in the space 46 adjacent to the spherical member 50 to retain one end of the strap. In other applications, as shown for example in FIG. 4, the opposite spherical member 50 may be passed through the space 46 between the two resilient members 40. As a result, the opposing end of the strap 120 may be cinched upon or create a loop 122 on another portion of the dishwasher rack. In some embodiments, the two resilient members 40 may contact or engage the same or adjacent lateral sides of an article 1 and/or the article may pass through the space 46 between the two resilient members 40 and therefore engage opposing sides of the article for example. Further, the space 46 between the adjacent resilient members 40 may engage another spherical member 50 of another strap assembly to create another strap pattern/configuration to retain one or more articles.

Figure 1B:
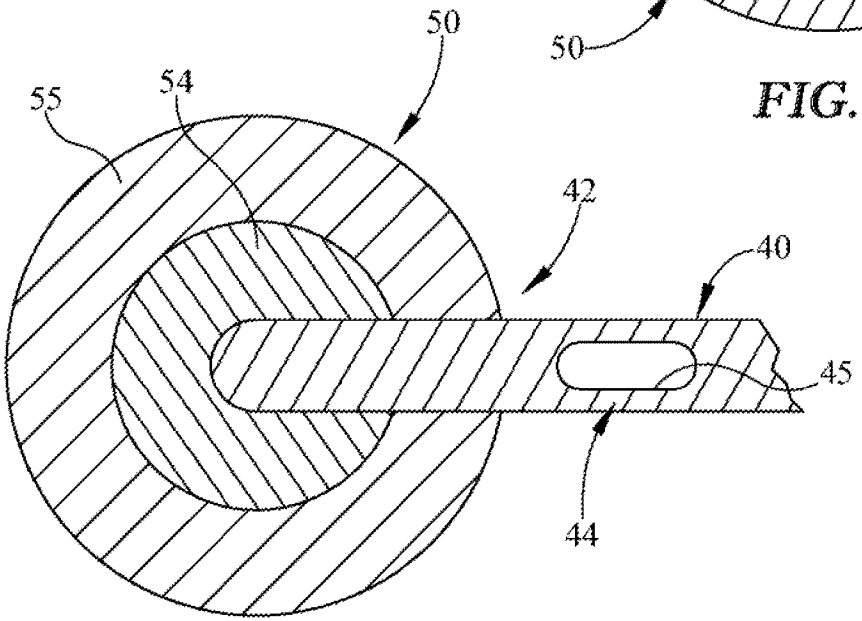
FIG. 1B is a sectional view of another embodiment of a strap assembly of FIG. 1 taken along line 1B-1B.

The one or more strap assemblies 20 may be formed of a variety of one or more materials. The strap 20, or portions thereof, may be formed of a heat and/or water resistant elastic material, such as, but is not limited to, silicone rubber, thermoplastic elastomer (TPE), etc. As shown in the one embodiment of FIG. 1A, the resilient member 40 and/or spherical member 50 may be formed of the same materials in some embodiments. In some embodiments, the resilient and spherical members may be made of the same material but may have different characteristic and properties. For example, as shown in FIG. 1B, the spherical member 50 may have made of a first inner portion 54 made from of a first material and the over molded second outer portion 55 may be made of a second material. The second material and first material may be formed of a silicone material, however the first material may be of a higher density or different characteristic. Although not shown, the resilient member may be formed by co-molding one or more materials. In some preferred embodiments, at least the outermost extent or contacting surfaces of the strap assembly, or portions thereof, may be formed of a material that includes at least one of the silicone and thermoplastic elastomer materials. Therefore, in various embodiments, a second interior material and/or non-contacting surface(s) may be a second material different from the outermost first material and still provide the barrier or padding to the article. In other embodiments, as shown in FIG. 1B, the resilient member and spherical member may be made of different materials. In various embodiments, the resilient member is made entirely of the same material. In some embodiments, the resilient member and the one or more spherical members may be made of the same material. In addition, in some embodiments, each one of the spherical members may be made entirely of the same material. In some embodiments, the spherical member(s) and the resilient member may be made of an inner material and outer material (e.g. same or different material).

In use, the user may secure one or more articles 1 within the dishwasher rack with one or more strap assemblies 20. The strap assemblies may be the same or different and be used, alone or together, to secure one or more articles in the rows and/or columns of the rack. A variety of configurations or patterns may be constructed with one or more strap assemblies. The one or more articles 1 may be positioned and subsequently secured within one or more dishwasher racks 30 (e.g. upper and/or lower rack). Although the strap(s) may be positioned/orientated within the dishwasher rack before placement of the one or more articles, it should be understood that one or more straps may be subsequently added to engage the article(s). The user may secure the opposing ends of the strap assembly to a respective portion of the dishwasher rack 30. The spherical members 50 may be frictionally engaged with the dishwasher rack or portions of the same or another strap. For example, the spherical member 50 may engage a portion (e.g. catch 44, space 46 between two or more resilient members, etc) of the resilient member (e.g. of the same or different strap) to engage the dishwasher rack. Moreover, in some applications, the dishwasher rack (e.g. prongs) and/or articles may redirect one or more portions of the one or more resilient members in a variety of orientations (e.g. parallel, nonparallel, arcuate, angled, etc. relative to remaining or other portions of the resilient member) to secure the article(s). Regardless if the article is positioned before or after a portion of the strap assembly is secured, the resilient member(s) or portions thereof may be stretched between the first and second spherical members or strap ends to their desired application or configuration. In some embodiments, the resilient member may not need to be substantially stretched (e.g. when the strap is a divider, barrier, or pad) The strap assemblies, or portions thereof, may be stretched or positioned across one or more columns of the dishwasher rack and/or one or more rows of the dishwasher rack to engage the one or more articles. The strap assembly may subdivide the dishwasher rack into additional compartments/areas (e.g. divide column (s) and/or row(s)). In some embodiments after the wash cycle of the dishwasher, the user may remove the one or more articles leaving the one or more strap assemblies in place for subsequent use, remove the strap assemblies from the rack, and/or rearrange the strap assemblies to a storage position or another location within the dishwasher rack until the next application.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A strap assembly for retaining at least one article with a dishwasher rack, the strap assembly comprising:

at least one resilient member having a first end and an opposing second end;

a first spherical member attached to the first end of the at least one resilient member; and a second spherical member attached to the second end of the at least one resilient member;

wherein the at least one resilient member includes one or more through openings positioned between the first spherical member and the second spherical member.

2. The strap assembly of claim 1 wherein a portion of each one of the at least one resilient member, the first spherical member, and the second spherical member includes an outermost extent made of a first material.

3. The strap assembly of claim 2 wherein the first material is at least one of silicone and a thermoplastic elastomer.

4. The strap assembly of claim 2 wherein the at least one resilient member is made entirely of the first material.

5. The strap assembly of claim 2 wherein the first spherical member and the second spherical member are made entirely of the first material.

6. The strap assembly of claim 2 wherein at least one of the first spherical member and the second spherical member includes a second material, wherein said second material is covered by the first material.

7. The strap assembly of claim 6 wherein the second material is denser than the first material.

8. The strap assembly of claim 1 wherein the at least one resilient member includes a plurality of the at least one resilient member.

9. The strap assembly of claim 1 wherein the at least one resilient member is adjustable in length.

10. The strap assembly of claim 1 wherein the at least one resilient member includes a plurality of the one or more through openings.

11. The strap assembly of claim 10 wherein the plurality of the one or more through openings are longitudinally spaced along a length of the at least one resilient member.

12. The strap assembly of claim 1 wherein the one or more through openings includes a first size at a rest position and a second size at an expanded position, wherein the first size is smaller than the second size.

* * * * *